US006560926B1

(12) United States Patent
Gillett

(10) Patent No.: US 6,560,926 B1
(45) Date of Patent: May 13, 2003

(54) REMOTELY CONTROLLED PET DOOR

(76) Inventor: Melvin E. Gillett, 3807 Gillett Ct., Howell, MI (US) 48843

( * ) Notice: Subject to any disclaimer, the term of this patent is extended or adjusted under 35 U.S.C. 154(b) by 0 days.

(21) Appl. No.: 09/222,629

(22) Filed: Dec. 29, 1998

(51) Int. Cl.[7] ..... E05D 15/48

(52) U.S. Cl. ..... 49/169; 49/170; 49/362; 49/25

(58) Field of Search ..... 49/169, 170, 360, 49/362, 25, 374; 160/180, 116, 188

(56) References Cited

U.S. PATENT DOCUMENTS

| | | | | | |
|---|---|---|---|---|---|
| 1,970,905 | A | * | 8/1934 | Gillen | 49/136 |
| 2,714,472 | A | * | 8/1955 | Richardson | 222/63 |
| 3,719,005 | A | * | 3/1973 | Carli | 49/28 |
| 3,918,201 | A | | 11/1975 | Graziano | |
| 4,322,913 | A | | 4/1982 | Himmer | |
| 4,426,639 | A | * | 1/1984 | Jessup | 340/528 |
| 4,497,133 | A | * | 2/1985 | Blenkinsop | 49/31 |
| 4,614,057 | A | * | 9/1986 | Sorber | 49/29 |
| 4,823,010 | A | * | 4/1989 | Kornbrekke et al. | 250/341.7 |
| 4,858,383 | A | * | 8/1989 | Kendig | 49/360 |
| 4,914,859 | A | * | 4/1990 | Gionet et al. | 49/25 |
| 5,072,544 | A | | 12/1991 | Breck, Jr. | |
| 5,177,900 | A | | 1/1993 | Solowiej | |
| 5,347,755 | A | * | 9/1994 | Jaster et al. | 49/25 |
| 5,422,552 | A | | 6/1995 | Parisi | |
| 5,467,559 | A | * | 11/1995 | Owens | 49/321 |
| 5,581,944 | A | * | 12/1996 | Kornbrekke et al. | 49/28 |
| 5,651,331 | A | | 7/1997 | Cleri, Jr. | |
| 5,752,343 | A | * | 5/1998 | Quintus | 49/29 |
| 5,813,364 | A | * | 9/1998 | Harrison | 119/501 |
| 5,967,215 | A | * | 10/1999 | Needham et al. | 160/180 |
| 5,992,096 | A | * | 11/1999 | De La Cerda et al. | 49/169 |
| 6,020,703 | A | * | 2/2000 | Telmet | 318/480 |

FOREIGN PATENT DOCUMENTS

| | | | |
|---|---|---|---|
| GB | 528421 | * 10/1940 | 49/362 |

* cited by examiner

*Primary Examiner*—Gregory J. Strimbu
(74) *Attorney, Agent, or Firm*—Mary M. Moyne; Ian C. McLeod

(57) ABSTRACT

A pet door unit having a housing, an opening mechanism, a pet door, a receiver and a portable transmitter. The opening mechanism includes a motor having a screw drive and a carriage. The carriage is connected to the top of the pet door and moves along the length of a screw shaft of the screw drive as the shaft rotates to open and close the door. A detector is mounted on each of the sidewalls of the housing to detect an object in the opening of the housing and prevent the door from closing when an object is detected in the opening. To open the door, a user presses a button on the portable transmitter which sends a signal to the receiver which activates the opening mechanism to move the door to the open position.

14 Claims, 6 Drawing Sheets

REMOTELY CONTROLLED PET DOOR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

Figure 1:
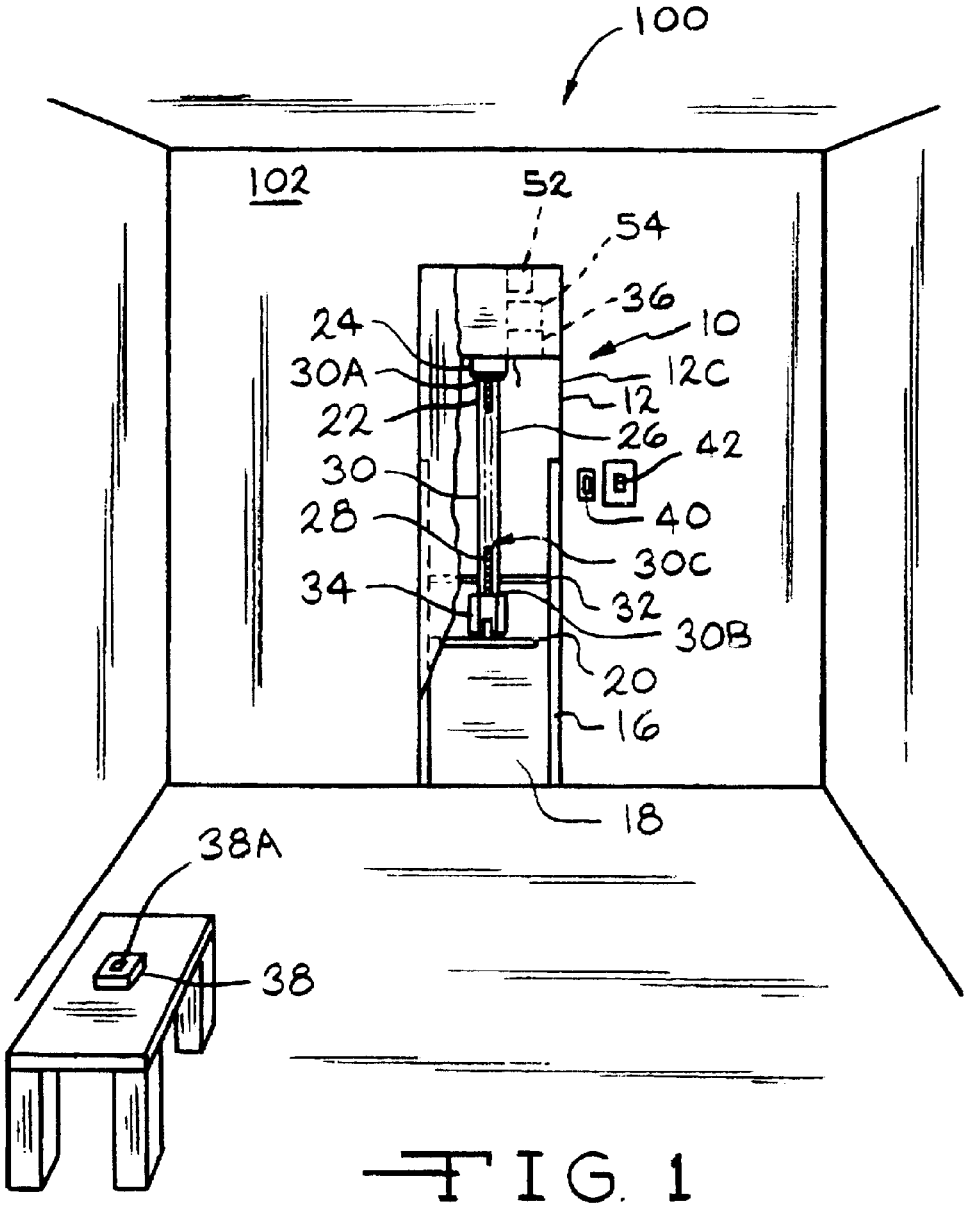

The present invention relates to a pet door which is remotely opened by a user. In particular, the present invention relates to a pet door which uses a vertical opening mechanism to lift the door into the open position in response to a signal from a portable transmitter controlled by the user.

2. Description of the Related Art

The related art has shown various types of pet door mechanisms. Illustrative are U.S. Pat. No. 4,322,913 to Himmer; U.S. Pat. No. 5,072,544 to Breck, Jr.; U.S. Pat. No. 5,177,900 to Solowiej and U.S. Pat. No. 5,651,331 to Cleri, Jr.

Himmer describes a vertically sliding pet door. The operating mechanism is a motor which rotates a shaft having a flexible line which is connected to the top of the door. The door is activated when the pet steps on either of a pair of floor mounted pressure pads mounted adjacent the inside and outside of the door, respectively.

Breck, Jr. shows an electrically powered pet door. The opening mechanism is a rotational and transitional drive unit which decreases the length of a line attached to the door to lift the door. The door is opened when the pet depresses a pedal plate on either the outside or.inside of the door.

Solowiej shows an automatic, vertical pet door for mounting between studs of a wall. The opening mechanism is an arm which rotates upward in an arc and moves in a slot in the door to open the door. The structure of the arm of the opening mechanism prevents the door from being lifted when the motor is not activated. The door is opened when the pet, having a transmitter unit on its collar, comes within range of a detector mounted on the framework of the door. The transmitter signal can be of any of infrared, ultraviolet, ultrasound or electromagnetic transmissions. The door stays open a predetermined amount of time as determined by a delay mechanism. If the pet is still within range of the detector, when the door begins to close, the door will reopen which prevents the pet from being hurt by the door.

Cleri, Jr. discloses a vertically or horizontally opening emergency pet door which is adapted to be mounted between studs in a building. The opening mechanism is a motor having a cord which is attached to the top of the door. As the motor rotates, the door is opened. The door has a speaker with a recorder to call the pet to the door. The door also has a smoke detector unit which activates the opening mechanism when smoke is detected.

Also of interest is U.S. Pat. No. 3,918,201 to Graziano which describes a horizontally sliding door in which the opening mechanism is a threaded rod rotated by a motor having a nut mounted thereon and attached to the door.

Only of minimal interest is U.S. Pat. No. 5,422,552 to Parisi which describes an automated actuator for use with sliding doors which ceases the sliding movement of the door when the door meets resistance and re-tests for the resistance to determine whether the door should continue along the intended path.

There remains the need for a pet door unit using a screw drive to vertically open the door in response to a signal from a portable transmitter controlled by the user.

SUMMARY OF THE INVENTION

The present invention is a pet door unit which opens in response to a signal from a portable transmitter. The pet door unit has a housing which is adapted to be mounted between a pair of standard studs in a structure. The door is mounted such as to open vertically by a opening mechanism. The opening mechanism includes a motor having a screw drive and a carriage movably mounted on the screw drive. The carriage is also connected to the top of the door such that as the screw drive rotates, the carriage moves along the screw drive and opens and closes the door. The screw drive prevents the door from being forced opened when the unit is not activated. The opening mechanism has a receiver which receives a signal from the portable transmitter to open the door. The portable transmitter enables the user to open the door from a distance either from inside or outside the structure.

The substance and advantages of the present invention will become increasingly apparent by reference to the following drawings and the description.

BRIEF DESCRIPTION OF THE DRAWING(S)

FIG. 1 is a perspective view of the pet door unit 10 mounted in the wall 102 of the structure 100 having a cutaway portion showing the opening mechanism 22.

Figures 2, 2A:
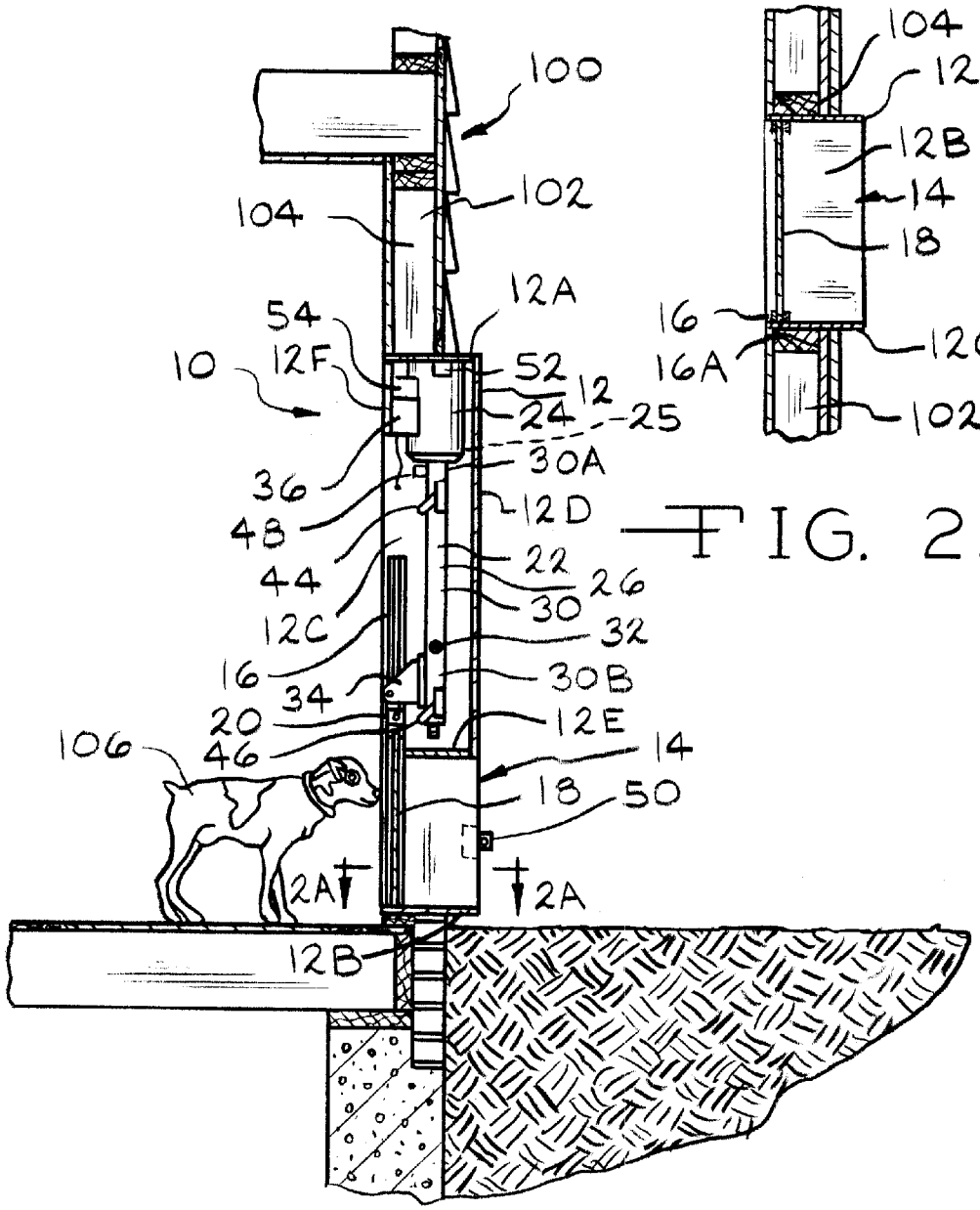

FIG. 2 is a cross-sectional side view of the pet door unit 10 mounted in the wall 102 of the structure 100 showing the door 18 in the "closed" position.

FIG. 2A is a cross-sectional view along the line 2A—2A of FIG. 2 showing the door 18 mounted in the rails 16.

Figure 3:
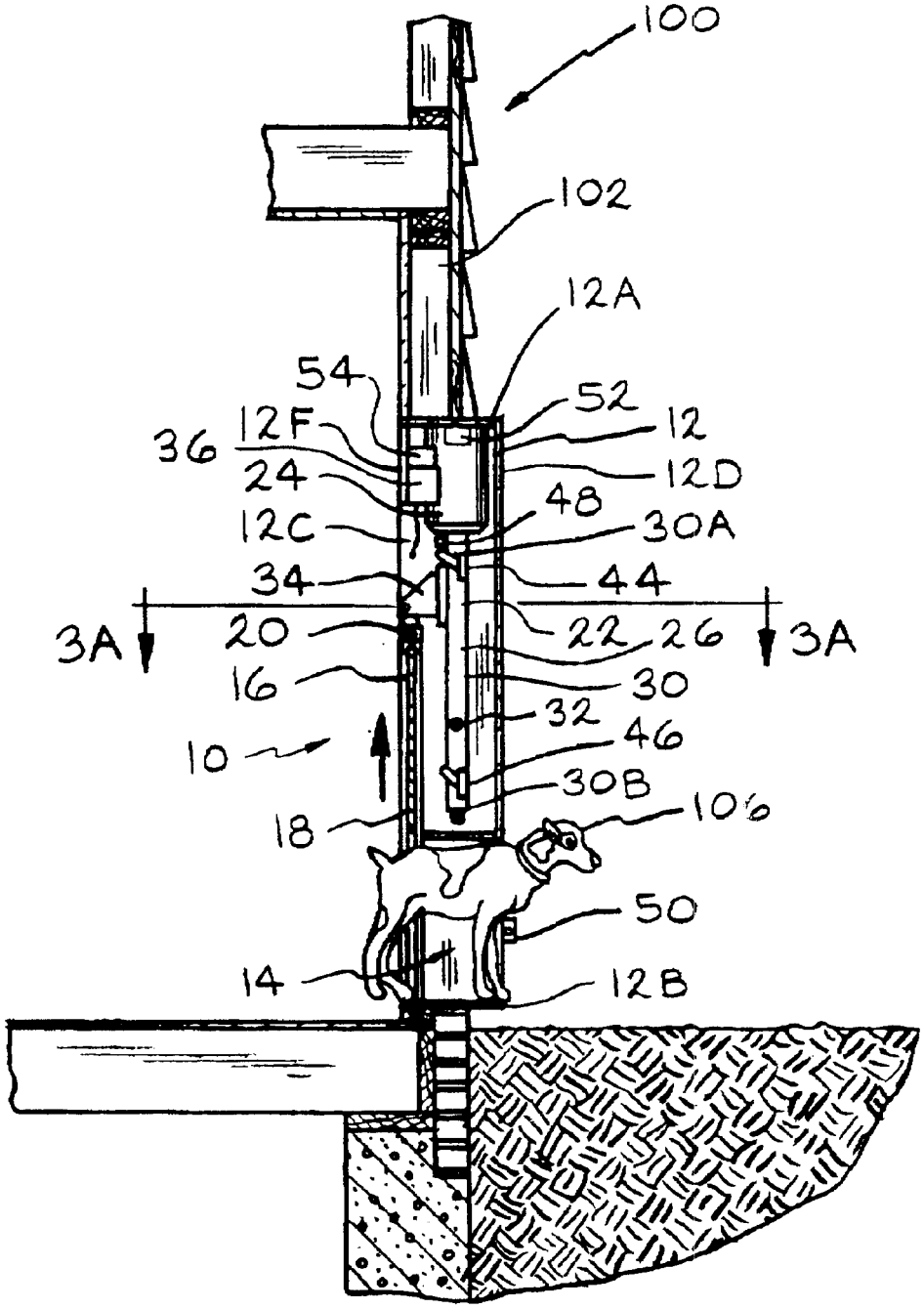

FIG. 3 is a cross-sectional side view of the pet door unit 10 mounted in the wall 102 of a structure 100 showing the door 18 in the "open" position.

Figure 3A:
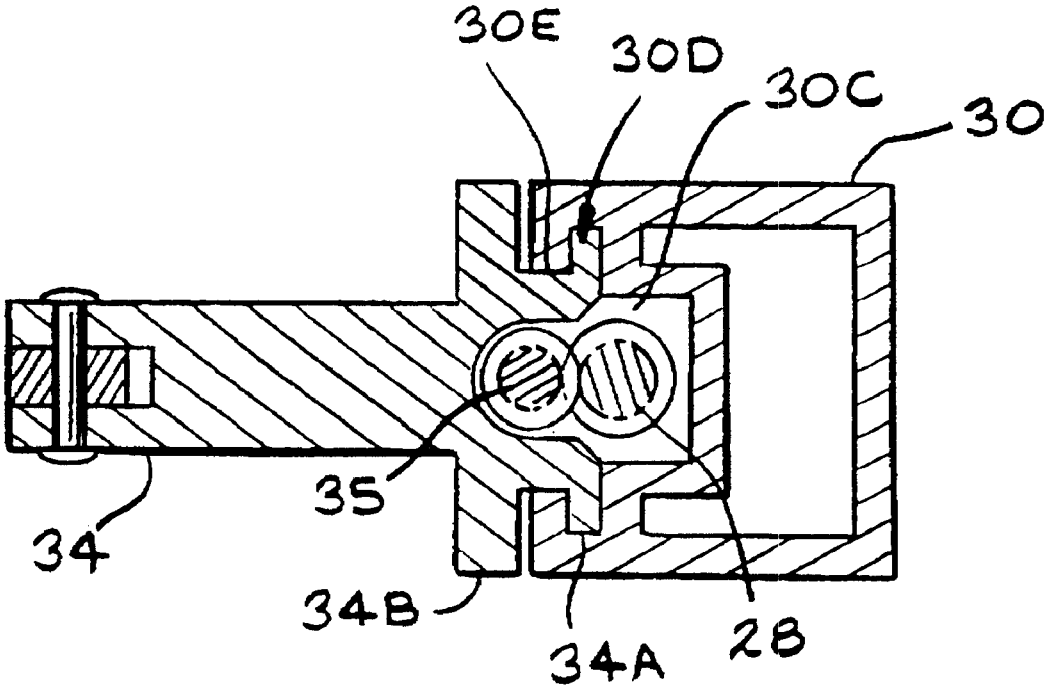

FIG. 3A is a cross-sectional view along the line 3A—3A of FIG. 3 showing the carriage 34 positioned in the rail unit 30.

Figure 4:
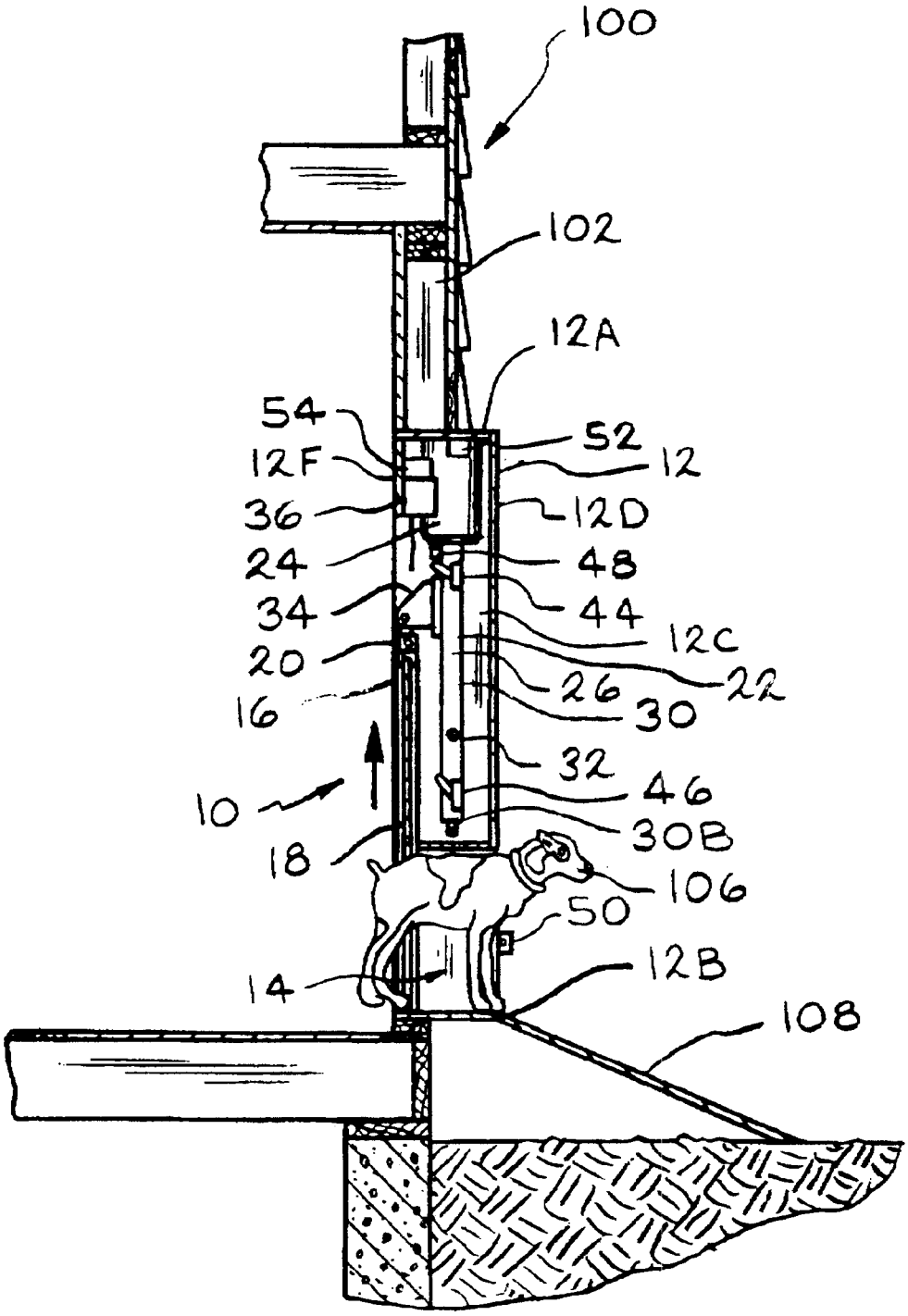

FIG. 4 is a cross-sectional side view of the pet door unit 10 in an alternate embodiment mounted in the wall 102 of a structure 100 showing the door 18 in the "open" position.

Figure 5:
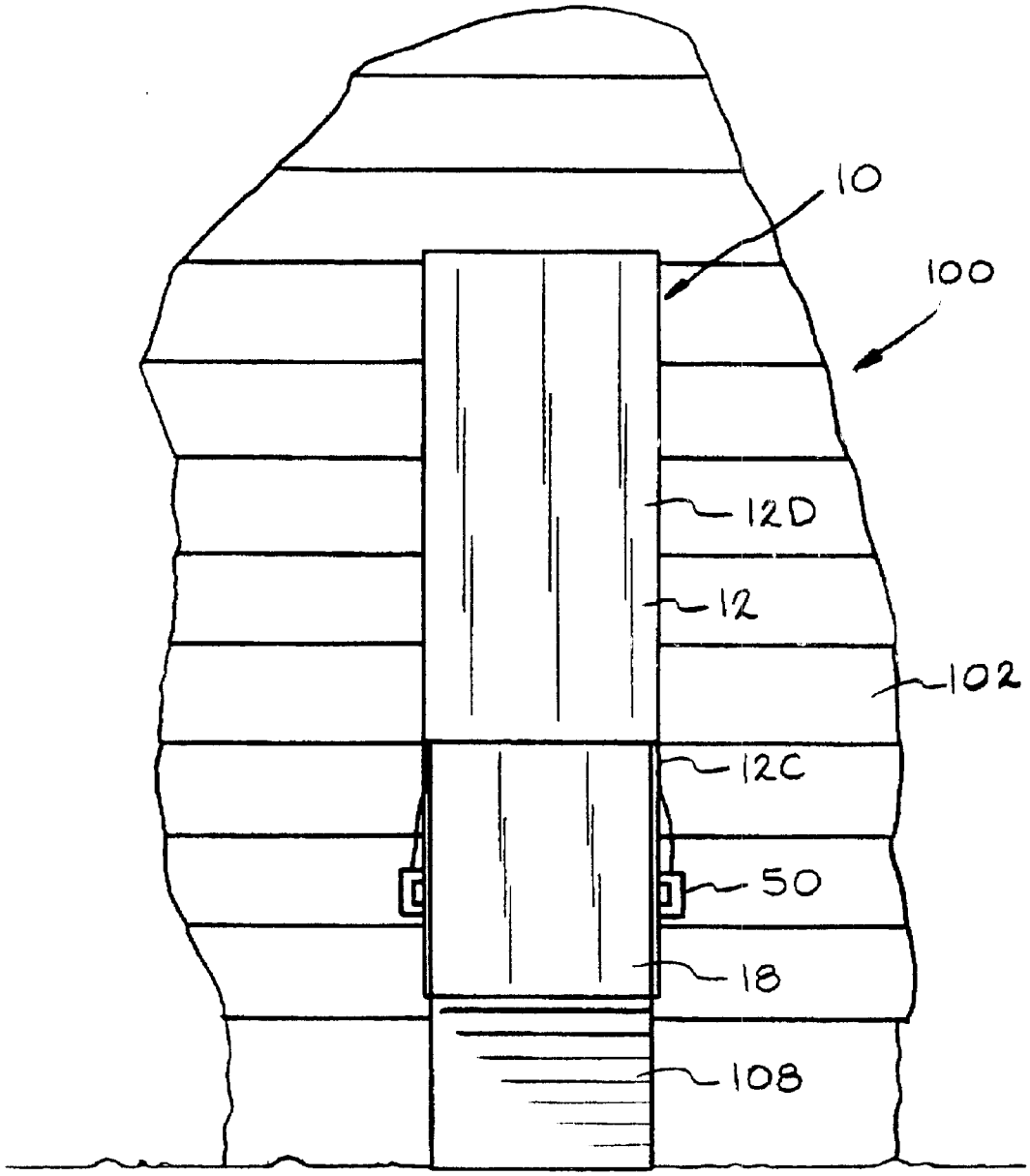

FIG. 5 is a back view of the pet door unit 10 with the door 18 in the "closed" position.

DESCRIPTION OF THE PREFERRED EMBODIMENT(S)

The present invention relates to a remotely controlled pet door unit for mounting in a structure having an opening, which comprises: an opening mechanism having a shaft; a door having a connection means for movably connecting the door to the shaft for movement of the door along a length of the shaft wherein the door is positioned such as to open and close the opening in the unit; and remotely controlled means for activating the opening mechanism to move the door, the control means having a receiver electrically connected to the opening mechanism and a portable transmitter spaced apart from the opening mechanism wherein in response to a signal from the transmitter, the receiver activates the opening mechanism to move the door.

Further, the present invention relates to a remotely controlled pet door unit for mounting in a structure having an opening, which comprises: a housing having a first end and a second end; a vertical opening mechanism mounted in the housing adjacent the first end of the housing and having a shaft extending toward the second end of the housing; a door movably mounted between the ends of the housing, the door having a connection means for movably connecting the door to the shaft of the opening mechanism for movement along a length of the shaft to open and close the opening of the unit; and remotely controlled means for activating the opening mechanism to move the door, the control means having a receiver electrically connected to the opening mechanism and a portable transmitter spaced apart from the housing wherein in response to a signal from the transmitter, the receiver activates the opening mechanism to move the door.

Still further, the present invention relates to a remotely controlled pet door unit for mounting in a structure having an opening, which comprises: a housing having a first end and a second end forming a longitudinal axis of the housing; a vertical opening mechanism mounted in the housing having a control circuit, a motor and a rotating screw shaft with the shaft extending between the first end and the second end of the housing parallel to the longitudinal axis of the housing; a door slidably mounted between the ends of the housing for movement parallel to the longitudinal axis of the housing for opening and closing the opening in the structure; connection means fixably mounted on the door for movably connecting the door to the screw shaft so that when the screw shaft rotates, the connection means moves along a length of the shaft such as to move the door to open and close the opening; and remotely controlled means for activating the vertical opening mechanism, the control means having a receiver electrically connected to the opening mechanism and a portable transmitter spaced apart from the unit for transmitting a signal to the receiver to activate the opening mechanism to move the door.

FIG. 1 shows the remotely controlled pet door unit 10 of the present invention. The unit 10 preferably includes a housing 12, an opening mechanism 22, a pet door 18, a receiver 36 and a portable transmitter 38. The housing 12 preferably includes a top wall 12A and a bottom wall 12B with two sidewalls 12C spaced therebetween. The housing 12 also includes a rear wall 12D extending downward from the top wall 12A to a point spaced above the bottom wall 12B which provides an opening 14 in the unit 10 to allow the pet 106 to move through the unit 10 and an opening in the wall 102 of the structure 100. The unit 10 is intended to be mounted in an opening in the wall 102 of a structure 100 (FIG. 1). The unit 10 is preferably positioned between a structure 100 such as a house and a garage (not shown) or on the outside wall of the structure 100. In the preferred embodiment, the width of the housing 12 of the unit 10 is such that the unit 10 will fit between two (2) studs 104 in a standard structure 100. The thickness of the housing 12 is preferably such that the unit 10 can be mounted in a wall 102 of the structure 100 and extend only a small distance beyond the surface of the wall 102 on one side. Alternatively, the thickness of the housing 12 is such that when the unit 10 is mounted in the wall 102 of the structure 100, the unit 10 does not extend beyond the surface of the wall 102 of the structure 100 on either side. The housing 12 is preferably about 6.0 feet (15.2 cm) in height and has a width of 14.5 inches (36.8 cm). The housing 12 can be constructed of a number of materials. In the preferred embodiment, the housing 12 is constructed of aluminum. The housing 12 is also provided with a center wall 12E which extends between the sidewalls 12C at the bottom end of the rear wall 12D (FIGS. 2 and 3). The center wall 12E extends outward from the rear wall 12D toward a front of the housing 12. The center wall 12E does not extend completely across the depth of the housing 12 such as to provide a space for the door 18 to be withdrawn into the interior of the housing 12. The center wall 12E prevents access to the interior of the housing 12 from the opening 14. In the preferred embodiment, the housing 12 has a short front wall 12F adjacent the top wall 12A of the housing 12. The front wall 12F, the top wall 12A, rear wall 12D and sidewalls 12C of the housing 12 surround the motor 24 and receiver 36 of the opening mechanism 22.

The inner surface of the sidewalls 12C of the housing 12 adjacent the front of the housing 12 are provided with guide rails 16. The guide rails 16 extend upward from the bottom wall 12B of the housing 12 parallel to the rear wall 12D of the housing 12. The guide rails 16 have channels 16A extending along their length (FIG. 2A). The channels 16A are of such a width as to accommodate the width of the pet door 18 while allowing the pet door 18 to slide up and down within the guide rails 16 without extraneous front to back movement of the door 18. The unit 10 is preferably mounted such that the pet door 18 is adjacent the inner wall 102 of the structure 100.

The door 18 is preferably mounted in the housing 12 between the guide rails 16 on the sidewalls 12C of the housing 12. The door 18 has such a height as to completely cover the opening 14 in the lower portion of the housing 12 and then extend slightly above the top of the opening 14 (FIG. 5). In the preferred embodiment, the opening 14 has a height of about 24 inches (61.0 cm) and a width of about 12.0 inches (30.5 cm). However, the height of the door 18 is such that when in the fully raised, open position, the top of the door 18 does not interfere with the motor 24 of the opening mechanism 22. The door 18 preferably has a thickness of 0.75 inches (1.91 cm) and is constructed of a lightweight, durable material such as laminated particle board. The material used to construct the door 18 also preferably provides insulation for the opening 14. The small size of the opening 14 allows for less loss of energy when the door 18 is opened to allow the pet to enter.

The opening mechanism 22 includes a motor 24 having a receiver 36, a screw drive 26 and a carriage 34 movably mounted on the screw drive 26. The opening mechanism 22 is preferably similar to those used in standard garage door openers such as the Automatic Screw Drive Garage Door Operating System sold by GENIE® located in Alliance, Ohio. The opening mechanism 22 is mounted such that the motor 24 and receiver 36 are located adjacent the top wall 12A of the housing 12 and the screw drive 26 extends downward toward the center wall 12E of the housing 12. The screw drive 26 is mounted such as to extend downward from the motor 24 parallel to the rear wall 12D of the housing 12. The screw drive 26 is preferably equally spaced between the sidewalls 12C of the housing 12. The screw drive 26 includes a screw shaft 28 surrounded by a rail unit 30. The rail unit 30 has a half circular groove 30C within which the screw shaft 28 is rotatably located. The front of the groove 30C has an opening along its length which allows access to the screw shaft 28. A pair of flanges 30E are provided on the rail unit 30 spaced above the top of the groove 30C such as to form a pair of channels 30D on either side of the groove 30C along the length of the rail unit 30. The screw shaft 28 is connected to the drive shaft (not shown) of the motor 24. The top end 30A of the rail unit 30 is mounted to the housing of the motor 24. The bottom end 30B of the rail unit 30 is securely held in place by a rod 32 which extends between the sidewalls 12C of the housing 12 and through the rail unit 30.

The carriage 34 is slidably mounted in the groove 30C of the rail unit 30 and has a pair of first flanges 34A and a pair of second flanges 34B. The first flange 34A slide within the channels 30D along the top of the groove 30C of the rail unit 30. The carriage 34 has a threaded shaft 35 fixably mounted between the first and second flanges 34A and 34B such that a portion of the threaded shaft 36 extends beyond the first flanges 34A. When the carriage 34 is mounted on the rail unit 30, the first flanges 34A are located in the pair of channels 30D on either side of the groove 30C and the threaded shaft 35 of the carriage 34 is in contact with the screw shaft 28 of the screw drive 26. The second flanges 34B are spaced apart from the first flanges 34A such that the flanges 30E of the rail unit 30 are spaced between the first and second flanges 34A and 34B of the carriage 34 (FIG. 34). The carriage 34 is removably mounted to the top of the door 18. A bracket 20 is attached at one end to the door 18 and is connected at the other end to the carriage 34. The bracket 20 is preferably positioned in the center of the door, 18 at the top of the door 18. The bracket 20 is positioned such that when the screw shaft 28 of-the screw drive 26 of the opening mechanism 22 rotates, the door 18 moves along the screw shaft 28 such that the screw shaft 28 extends along the rear side of the door 18 adjacent the rear wall 12D of the housing 12.

The opening mechanism 22 is provided with a receiver 36 to receive signals from the portable transmitter 38 to "open" the pet door 18. In the preferred embodiment, the transmitter 38 and receiver 36 are similar to those used for garage door openers. The portable transmitter 38 preferably transmits a radio wave frequency signal. However, any other well known types of signals such as infrared, ultraviolet, ultrasound or electromagnetic could be used. In the preferred embodiment, the receiver 36 is located in the housing 12 adjacent the motor 24. Preferably, a manual switch 40 is provided in the wall 102 of the structure 100 adjacent the unit 10, to enable the opening mechanism 22 to be activated at the housing 12 without the need of the portable transmitter 38 (FIG. 1). The unit 10 is also provided with a power switch 42 to completely deactivate the unit 10 when not in use. The power switch 42 preferably only deactivates the unit 10 when the door 18 is in the completely closed position. When the power switch 42 is in the "on" position, the opening mechanism 22 can be activated to open the door 18 using either the portable transmitter 38 or the manual switch 40. The manual switch 40 and power switch 42 are preferably located on the interior of the structure 100 (FIG. 1). In the preferred embodiment, the unit 10 is wired directly into the electrical system of the structure 100. Alternatively, the unit 10 is provided with an electrical plug (not shown) which is plugged into a standard electrical outlet (not shown) in the structure 100.

An open limit switch 44 is preferably mounted at the top end of the screw drive 26. A closed limit switch 46 is preferably located at the bottom end of the screw drive 26 (FIGS. 2 and 3). The limit switches 44 and 46 cut power to the opening mechanism 22 when the carriage 34 contacts either of the limit switches 44 or 46 once the door 18 is in the fully open or fully closed position. The rail unit 30 is also provided with a carriage stop 48 at the top end to prevent the carriage 34 from contacting the motor 24 of the opening mechanism 22 if the open limit switch 44 should fail.

A pair of detectors or sensors 50 are mounted on each of the sidewalls 12C of the housing 12 at the opening 14 of the housing 12 adjacent the rear wall 12D of the housing 12 (FIG. 5). The detectors 50 detect an object or pet 106 between the sidewalls 12C of the housing 12 in the opening 14 of the housing 12. The detectors 50 prevent the door 18 from closing when an object or pet 106 is sensed by the detectors 50. The detectors 50 preferably reset the opening mechanism 22 such that the door 18 will re-open completely and will remain in the "open" position for the entire preset delay period (to be discussed in detail hereinafter). A motion detector (not shown) can also be provided on the interior side of the door 18 to allow the door 18 to open automatically when a pet 106 is near the door 18. The opening mechanism 22 is also provided with a delay circuit 52 which automatically closes the door 18 after a preset amount of time. In the preferred embodiment, the delay period can be adjusted. Alternatively, the portable transmitter 38 can be used to send a second signal which reactivates the opening mechanism 22 to move the door 18 into the "closed" position. The opening mechanism 22 is also provided with an auto-reverse safety mechanism 54 which automatically reverses the direction of the motor 24 and the movement of the door 18 from the closing direction to the opening direction when the bottom of the door 18 encounters an object or pet 106.

In use, the unit 10 is mounted between the studs 104 of a structure 100 in an opening in the wall 102 of the structure 100. Preferably, the unit 10 is mounted in place by fasteners (not shown) secured through the sidewalls 12C of the housing 12 and into the adjacent studs 104. The opening mechanism 22 of the unit 10 is either wired directly into the electrical system (not shown) of the structure 100 or is plugged into an electrical outlet. Next, the power switch 42 and the manual switch 40 are mounted adjacent to the unit 10 in the wall 102 of the structure 100. In an alternate embodiment, the power switch 42 can be mounted directly in the housing 12 and extend through openings (not shown) in the wall 102 of the structure 100. In the preferred embodiment, the unit 10 is mounted such that the bottom wall 12B of the housing 12 is flush with the interior floor of the structure 100. In the preferred embodiment, the bottom wall 12B is also flush or only slightly above the ground surface or floor of an adjacent structure such as a garage (FIG. 2). In an alternate embodiment, the bottom wall 12B is spaced above the ground surface and a ramp 108 is provided to allow the pet 106 access to the door 18 (FIG. 4).

The user preferably carries the portable transmitter 38 around the structure 100. In response to a signal from the pet 106, the user presses a button 38A on the portable transmitter 38 to transmit a signal to the receiver 36 connected to the opening mechanism 22. In the preferred embodiment, the user can activate the unit 10 from another room in the structure 100 and does not need a direct line between the transmitter 38 and the unit 10. In addition, the user can preferably be upwards of 80.0 feet (2438.4 cm) from the unit 10 when activating the unit 10. Preferably, the user does not need to be directly in line with the unit 10. When the receiver 36 receives the signal, the opening mechanism 22 is activated which activates the motor 24 which in turn rotates the screw drive 26. In the initial closed position, the door 18 is completely covering the opening 14 of the housing 12 with the bottom of the door 18 in contact with the bottom wall 12B of the housing 12 (FIG. 2). In the closed position, the carriage 34 is adjacent the bottom end of the screw drive 26. As the screw shaft 28 rotates, the fixed, threaded shaft 35 of the carriage 34 engages the moving threads of the screw shaft 28 and moves along the screw shaft 28 toward the top of the screw drive 26. As the carriage 34 moves upward, the door 18 is opened. The door 18 continues to move upward at a speed of about 8.0 inches/second (20.3 cm/sec). As the door 18 moves into the fully open position (FIGS. 3 and 4), the carriage 34 contacts the open limit switch 44 which deactivates the motor 24 and holds the door 18 in the "open" position. As soon as the open limit switch 44 is contacted, the delay circuit 52 is activated to begin the count down until the door 18 is closed. In the preferred embodiment, the door 18 remains in the "open" position for between about 3 to 5 seconds. However, preferably the delay period is adjustable. When the door 18 has been open for the preset amount of time, the delay circuit 52 reactivates the motor 24 which rotates the screw shaft 28 in the opposite direction such that the carriage 34 moves down the shaft 28 and the door 18 is moved into the "closed" position. When the door 18 reaches the fully closed position (FIG. 2), the carriage 34 contacts the closed limit switch 46 which deactivates the motor 24 to hold the door 18 in the "closed" position. Due to the use of the rigid screw drive 26, once the door 18 is in the "closed" position, the door 18 is unable to be forced upward into an open position. If an object or the pet 106 moves into the opening 14, as the door 18 is moving into the "closed" position, the detectors 50 will be activated which activates the motor 24 to reverse the rotation of the screw shaft 28 and change the direction of movement of the door 18. The door 18 then moves upward to the fully open position and begins another opening cycle. As in the original opening cycle, the delay circuit 52 will hold the door 18 in the "open" position for a preset amount of time. In addition, during either opening or closing of the door 18, the user can push the button 38A on the transmitter 38 or press the manual switch 40 to reverse the direction of the door 18. When the door 18 is no longer needed, the user can turn the power switch,42 to the "off" position. When the unit 10 is turned off, the door 18 can not be opened.

It is intended that the foregoing description be only illustrative of the present invention and that the present invention be limited only by the hereinafter appended claims.

I claim:

1. A remotely controlled pet door unit for mounting in a structure, which comprises:

(a) an opening mechanism having a threaded shaft and a motor having a drive shaft connected to the threaded shaft wherein the drive shaft of the motor is coaxial with the threaded shaft;

(b) a door having a connection means for movably connecting the door to the threaded shaft for movement of the door in a vertical direction only between an open and a closed position along a length of the threaded shaft wherein the door is positioned in the open position so as to open an opening in the unit and the closed position so as to close the opening in the unit;

(c) a control system for activating the opening mechanism to move the door, the control system having a receiver electrically connected to the opening mechanism and a portable transmitter spaced apart from the opening in the unit and configured to be selectively operated by a person wherein in response to a signal from the transmitter, the receiver activates the opening mechanism to move the door; and (d) detectors connected to the opening mechanism to prevent the door from moving into the closed position when the detectors detect an object adjacent the door.

2. The pet door unit of claim 1 wherein the opening mechanism has a delay circuit which activates the opening mechanism after the door is in the open position for a preset amount of time to move the door into the closed position.

3. The pet door unit of claim 1 wherein the connection means is a movable carriage with a stationary threaded member which threadably mates with the threaded shaft of the opening mechanism such that when the threaded shaft of the opening mechanism rotates, the carriage moves vertically along the length of the threaded shaft of the opening mechanism.

4. The pet door unit of claim 1 wherein the opening mechanism has a manual switch which activates the opening mechanism to move the door.

5. A remotely controlled pet door unit for mounting in a structure, which comprises:

(a) a housing having a first end and a second end;

(b) a vertical opening mechanism mounted in the housing adjacent the first end of the housing, the opening mechanism having a threaded shaft extending toward the second end of the housing and a motor having a drive shaft connected to the threaded shaft wherein the drive shaft of the motor is coaxial with the threaded shaft;

(c) a door movably mounted between the ends of the housing, the door having a connection means for movably connecting the door to the threaded shaft of the opening mechanism for movement of the door in a vertical direction only between an open and a closed position along a length of the threaded shaft to move the door to the open position to open an opening of the unit and to move the door to the closed position to close the opening of the unit; and (d) a control system for activating the opening mechanism to move the door, the control system having a receiver electrically connected to the opening mechanism and a portable transmitter spaced apart from the housing and the opening of the unit and configured to be selectively operated by a person wherein in response to a signal from the transmitter, the receiver activates the opening mechanism to move the door; and (e) detectors connected to the opening mechanism and mounted adjacent the door to control the opening mechanism to prevent the door from moving into the closed position when the detectors detect an object adjacent the door.

6. The pet door unit of claim 5 wherein the opening mechanism has a manual switch which activates the opening mechanism to move the door.

7. The pet door unit of claim 5 wherein the housing has a depth so as to be mounted within a wall of the structure.

8. The pet door unit of claim 5 wherein the housing has a width such as to be able to be mounted between studs of the structure.

9. The pet door unit of claim 5 wherein the opening mechanism has a delay circuit which activates the opening mechanism after the door is in the open position a preset amount of time to move the door into the closed position.

10. The pet door unit of claim 5 wherein the housing has a left and right sidewall spaced between the ends wherein the left and right sidewalls each have an inside surface with a respective rail on the inside surface extending parallel to a longitudinal axis of the housing and wherein the door is slidably mounted between the rails for movement in the vertical direction between the open and closed positions along length of the rails.

11. The pet door unit of claim 5 wherein the connection means is a movable carriage with a stationary threaded member which threadably mates with the threaded shaft of the opening mechanism such that when the threaded shaft of the opening mechanism rotates, the carriage moves along the length of the threaded shaft of the opening mechanism in the vertical direction only.

12. A remotely controlled pet door unit for mounting in a structure, which comprises:

(a) a housing having a first end and a second end with a longitudinal axis of the housing extending between the ends;

(b) a vertical opening mechanism mounted in the housing having a control circuit, a motor having a drive shaft and connected to a rotatable screw shaft with the screw shaft extending between the first end and the second end of the housing parallel to the longitudinal axis of the housing wherein the drive shaft is coaxial with the screw shaft;

(c) a door slidably mounted between the ends of the housing for movement in a vertical direction only between an open and closed position parallel to the longitudinal axis of the housing so that the door is movable to the open position for opening an opening in the unit and to the closed position for closing the opening in the unit;

(d) connection means fixably mounted on the door for connecting the door to the screw shaft so that when the motor rotates the screw shaft, the connection means moves along a length of the screw shaft so as to move the door between the open and closed positions;

(e) a control system for activating the vertical opening mechanism, the control system having a receiver electrically connected to the opening mechanism and a portable transmitter spaced apart from the opening of the unit and configured to be selectively operated by a person for transmitting a signal to the receiver to activate the opening mechanism to move the door; and (f) detectors connected to the opening mechanism and mounted adjacent the door to prevent the door from moving into the closed position when an object is detected by the detectors adjacent the door.

13. The pet door unit of claim 12 wherein the housing has a pair of opposed sidewalls spaced between the ends wherein each of the sidewalls has an inside surface with a respective rail on the inside surface extending parallel to the longitudinal axis of the housing and wherein the door is slidably mounted in the rails for movement along a length of the rails.

14. The pet door unit of claim 12 wherein the opening mechanism has a delay circuit which activates the opening mechanism after the door is in the open position a preset amount of time to move the door into the closed position.

* * * * *